US007234848B2

(12) United States Patent
Dorr et al.

(10) Patent No.: US 7,234,848 B2
(45) Date of Patent: Jun. 26, 2007

(54) ADJUSTABLE LAMPSHADE

(75) Inventors: Brian Lawrence Dorr, Alpharetta, GA (US); Thomas Koch, Cumming, GA (US)

(73) Assignee: Finishing Touch Company, Alpharetta, GA (US)

( * ) Notice: Subject to any disclaimer, the term of this patent is extended or adjusted under 35 U.S.C. 154(b) by 18 days.

(21) Appl. No.: 11/156,905

(22) Filed: Jun. 20, 2005

(65) Prior Publication Data

US 2005/0281036 A1 Dec. 22, 2005

Related U.S. Application Data

(60) Provisional application No. 60/631,749, filed on Nov. 30, 2004, provisional application No. 60/581,797, filed on Jun. 21, 2004.

(51) Int. Cl.

| | |
|---|---|
| ***F21V 17/00*** | (2006.01) |
| ***F21V 17/04*** | (2006.01) |
| ***F21V 17/02*** | (2006.01) |
| ***F21V 11/00*** | (2006.01) |

(52) U.S. Cl. ..... 362/444; 362/440; 362/449; 362/351

(58) Field of Classification Search ..... 362/444, 362/351, 440, 449

See application file for complete search history.

(56) References Cited

U.S. PATENT DOCUMENTS

| | | | | |
|---|---|---|---|---|
| 1,797,689 | A * | 3/1931 | Malicher | 362/444 |
| 2,103,322 | A * | 12/1937 | De Sherbinin | 362/444 |
| 2,673,927 | A * | 3/1954 | De Sherbinin | 362/444 |
| 2,681,410 | A * | 6/1954 | De Sherbinin | 362/444 |
| 2,805,329 | A * | 9/1957 | Golden | 362/452 |
| 3,281,590 | A * | 10/1966 | Truax et al. | 362/322 |

* cited by examiner

*Primary Examiner*—John Anthony Ward
*Assistant Examiner*—David Makiya
(74) *Attorney, Agent, or Firm*—Blake I. Dorr

(57) ABSTRACT

A lampshade may comprise an upper rim, a cross-member having two ends connected to the upper rim, a clip having a spring portion and two arms, and a shade material connected to said upper rim. The cross-member may include a loop portion between the two ends, the spring portion may be connected to the loop portion of the cross-member, and the arms may be configured to engage a light source.

18 Claims, 5 Drawing Sheets

ADJUSTABLE LAMPSHADE

CROSS-REFERENCE TO RELATED APPLICATIONS

The present application claims the benefit of Provisional Application No. 60/581,797 filed Jun. 21, 2004 and Provisional Application No. 60/631,749 filed Nov. 30, 2004, both of which are incorporated herein by reference.

FIELD

This invention generally relates to a lampshade and, more particularly, to an adjustable lampshade.

BACKGROUND

Lampshades are vital components in lighting fixtures. They serve a number of purposes, such as directing light to a desired surface, reducing glare, and providing an attractive alternative to an unsightly lighting source such as a light bulb.

Lampshades are often used on chandeliers, lamps, and sconces. These types of lighting fixtures may use lampshades that mount directly to the fixture or to a lighting source such as a light bulb. These types of lighting fixtures are often difficult and hazardous to reach in order to install lampshades properly or to replace burned out light bulbs.

Once lampshades are installed on a lighting fixture, they often have to be removed and reinstalled to replace burned out light bulbs. After reinstallation, the shades usually require adjustment to improve the performance and the aesthetic appearance of the fixture.

FIG. 5 shows a configuration of a conventional lampshade assembly 13 attached to a light bulb 3. The lampshade assembly 13 has a conventional clip 5, which is made by bending a loop of wire over another wire, cross-member 7, and securing it with a fastener 9. When the clip 5 is mounted to a light bulb 3, it is spread apart to fit over the light bulb 3. The arrangement of the clip 5, cross-member 7, and fastener 9 generates tension in the clip 5 that holds the lampshade assembly in place.

The aforementioned lampshade assembly is commonly used to mount lampshades to lamps, chandlers, sconces, and other lighting fixtures. In addition, there are other conventional lampshades that mount directly to the candlestick 11, below the light bulb 3.

Though both of these approaches to mounting lampshades hold the shade in place, they each have disadvantages.

The conventional lampshades that mount directly to the candlestick hold the lampshade correctly with respect to the candlestick. However, they have a framework that is lower with respect to the top of the shade, which makes it exposed from below and thus detracts from the lampshade's appearance. Furthermore, these conventional lampshades cannot be adjusted.

In addition, conventional lampshades that mount on light bulbs, such as that shown in FIG. 5, cannot be easily adjusted either. Though lampshades have been used on oil lamps and candles (See Wantanabe U.S. Pat. No. 1,178,764, for example) and installed on fixtures using electric light bulbs for a number of years, there has not been a lampshade invented that allows one to easily adjust the angle of the lampshade once it is placed on a lighting fixture or light source.

Accordingly, it may be desirable to provide an improved lampshade assembly for facilitating adjustment of a lampshade to a desired angle after it has been installed on a fixture.

SUMMARY

According to various aspects of the disclosure, a lampshade comprises an upper rim, a cross-member having two ends connected to the upper rim, a clip having a spring portion and two arms, and a shade material connected to said upper rim. The cross-member may include a loop portion between the two ends, the spring portion may be connected to the loop portion of the cross-member, and the arms may be configured to engage a light source.

In accordance with various aspects, a lampshade comprises an upper rim, a cross member having two ends connected to the upper rim, a clip solidly mounted on the loop portion of the cross member, and a shade material connected to said upper rim. The cross-member may include a loop portion between the two ends, and the clip may be configured to engage a light source.

According to still other aspects, a lamp may comprise a candlestick; a light source electrically connected with the candlestick, and any one of the various exemplary lampshades connected to the light source.

BRIEF DESCRIPTION OF THE DRAWINGS

The forgoing and additional features and characteristics of the present invention will become more apparent from the following detailed description considered with reference to the accompanying drawing figures in which like reference numerals designate like elements and wherein.

DETAILED DESCRIPTION OF EXEMPLARY EMBODIMENTS

Figure 1:
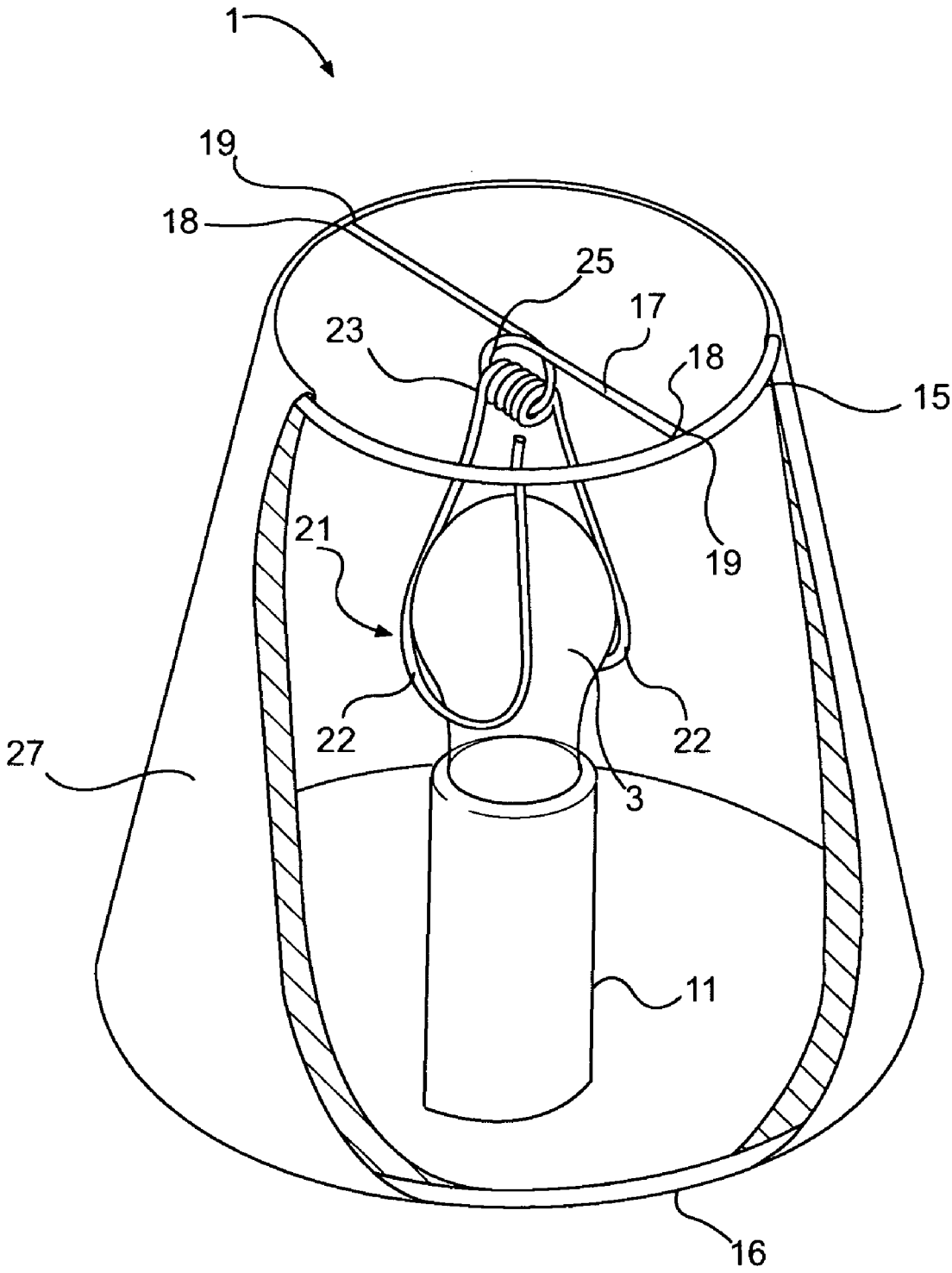
FIG. 1 is a partial broken perspective view of an exemplary lampshade according to various aspects of the invention.
Figure 2:
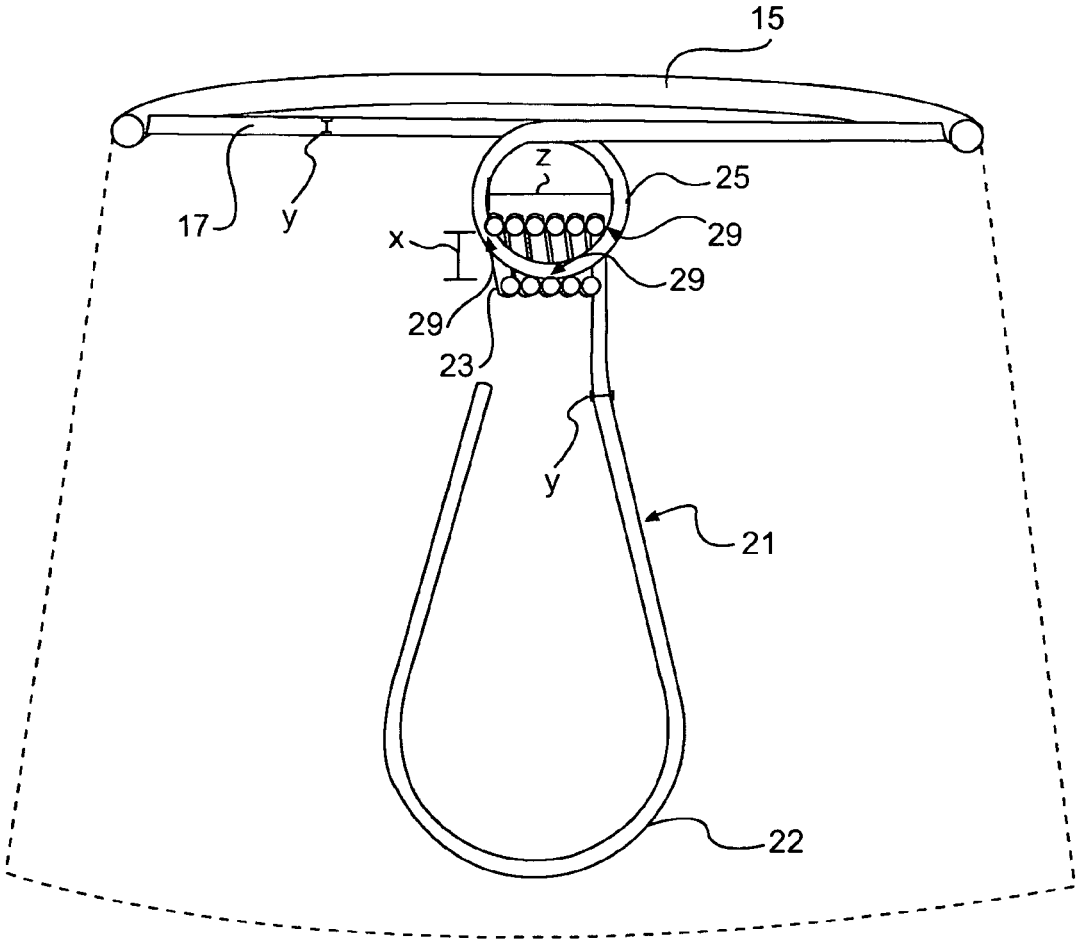
FIG. 2 is a front sectional view of the lampshade of FIG. 1.

Reference is now made to exemplary aspects of the invention as shown in FIGS. 1 and 2. FIG. 1 is a perspective view of an exemplary lampshade 1 mounted on a light bulb 3. A portion of shade material 27 of the lampshade 1 is removed in FIG. 1 for clarity. The lampshade 1 may include an upper rim 15 and a lower rim 16. The rims 15, 16 may be any desired shape, for example, round, square, or diamond shaped. The rims 15, 16 may have the same shape or different shapes. In various aspects of the invention, upper rim 15 and/or lower rim 16 may be made from wire. It should be appreciated that the rims 15, 16 may be constructed of any material that is sufficiently rigid to maintain the desired shape.

A cross-member 17 may be fixedly mounted to the upper rim 15. For example, the cross-member 17 may be mounted to the upper rim 15 by soldering or a welding the two ends 18 of the cross-member at points 19 of the upper rim 15. The points 19 may be across a diameter (for a round upper rim) or to opposing corners or opposing sides (for a square shaped upper rim) of the upper rim. According to various aspects of the invention, the cross-member 17 may be made from wire or any material that is sufficiently rigid to maintain the desired shape.

The lampshade 1 may further comprise a clip 21 configured to attach the lampshade to the light bulb 3. The clip 21 may include two arms 22 and a spring portion 23. The two arms 22 extend from opposite ends of the spring portion 23. The spring portion 23 may be configured to be connected to the cross-member 17, for example, at a loop portion 25 of the cross-member 17. According to various aspects, the spring portion 23 may be solidly mounted on the cross-member 17, for example, at the loop portion 25.

As shown in FIG. 2, the spring portion 23 may comprise, for example, a coil spring encircling a segment of the loop portion 25, which may form, for example, a ring. In various aspects, the loop portion may be substantially equidistant from the ends 18 of the cross-member 17, and thus the spring portion 23 may be connected to the cross-member 17 at a point substantially equidistant from the ends 18 of the cross-member 17. The loop portion 25 may be configured to create friction regions 29 (FIG. 2) between the inside surface of the spring portion 23 and the cross-member 17.

According to various aspects of the invention, the clip 21 may be made from wire or any material that is sufficiently rigid and resilient to provide a spring effect at the spring portion 23. The clip 21 may include a single-piece of unitary construction that is bent to form the two arms 22 and the spring portion 23.

FIG. 2 is a cross-sectional view of the front of the clip 21, the spring portion 23, the cross-member 17, and the loop portion 25. As shown in FIG. 2, the cross-member 17 may engage the spring at one or more of the three friction regions 29. The friction regions 29 may be facilitated by the loop portion 25 of the cross-member 17. The clip 21, the spring portion 23, and/or the cross-member 17 may be constructed of, for example, a wire material of diameter y. In various aspects, the inner diameter of the spring equals x, and the inner diameter of the loop equals z.

Referring back to FIG. 1, the shade material 27 may be connected to the upper rim 15 and the lower rim 16. In various aspects, the shade material 27 may be mounted around the upper rim 15 and secured on the lampshade by an adhesive on the upper rim 15 and/or on the shade material 27. In some aspects, the shade material 27 may be mounted around the upper rim 15 and sewn onto itself. Similarly, the shade material 27 may be mounted around the lower rim 16 and secured on the lampshade by an adhesive on the lower rim 16 and/or on the shade material 27. In some aspects, the shade material 27 may be mounted around the lower rim 16 and sewn onto itself.

According to various aspects, the shade material 27 may comprise silk, linen or other fabric or a paper product such as cardboard or hardboard. In some aspects, the shade material 27 may comprise a material sufficiently rigid to maintain a desired shape of the shade material 27, and the lower rim 16 may be eliminated. According to some aspects, the lampshade 1 may include a plurality of peripherally spaced rib members (not shown) fixedly mounted between the upper rim 15 and the lower rim 16. The rib members may be made from wire or any material that is sufficiently rigid to maintain the desired shape of the shade material 27.

In use, the lampshade 1 may be mounted to a light bulb 3 by urging the two arms 22 of the clip 21 away from one another. Once mounted on the light bulb 3, the contact between the loop portion 25 and the inside surface of the spring portion 23 at one or more of the friction regions 29 is sufficiently tight to keep the lampshade 1 from pivoting due to the force of gravity. The shape of the loop portion 25 with relation to the cylindrical shape of the inside surface of the spring portion 23 also allows the lampshade 1 to be adjusted by a user through a range of motion by pivoting the lampshade 1 along an axis substantially perpendicular to the cross-member and around the longitudinal axis of the cross-member 17.

Figure 3B:
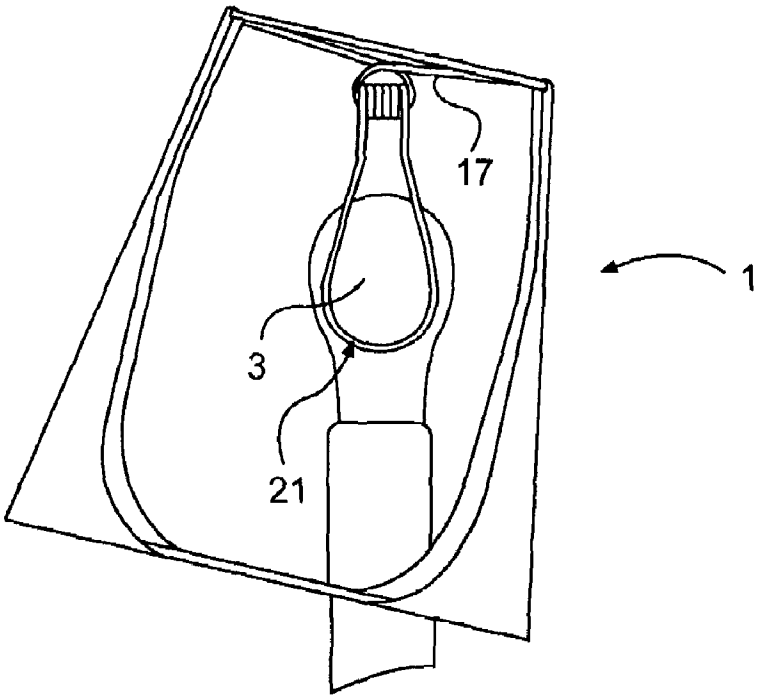
FIG. 3B is a partial broken front view of the lampshade of FIG. 1 in a tilted position.
Figure 3A:
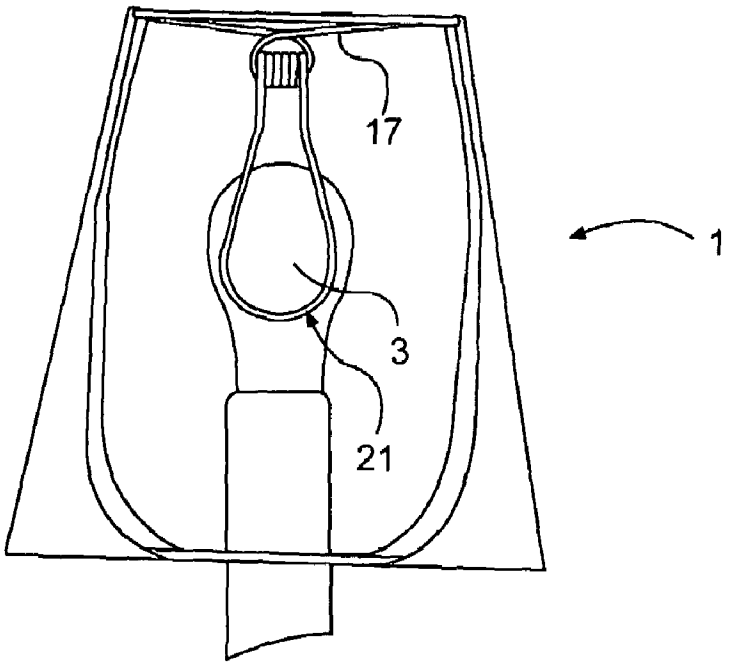
FIG. 3A is a partial broken front view of the lampshade of FIG. 1 in an upright position.

For example, in FIG. 3A, the lampshade 1 sits atop the light bulb 3 is a typical upright position. In FIG. 3B, the lampshade 1 sits atop the light bulb 3 in a desired adjusted position. In the adjusted position of FIG. 3B, the lampshade 1 has been pivoted to the left (relative to the position of FIG. 3A) by pivoting the clip 21 relative to the cross-member 17 about an axis substantially perpendicular to the cross-member 17. This adjustment may be made after the lampshade 1 has already been installed atop the light bulb 3. It should be appreciated that the lampshade 1 may also be pivoted to the right (relative to the position of FIG. 3A) by pivoting the clip 21 relative to the cross-member 17 about an axis substantially perpendicular to the cross-member 17 in a similar manner.

Figure 4B:
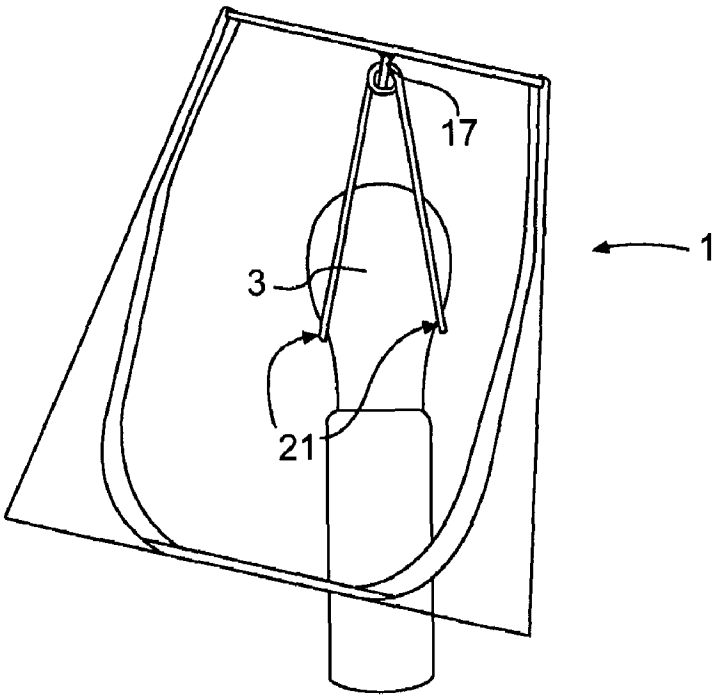
FIG. 4B is a partial broken side view of the lampshade of FIG. 1 in a tilted position.
Figure 4A:
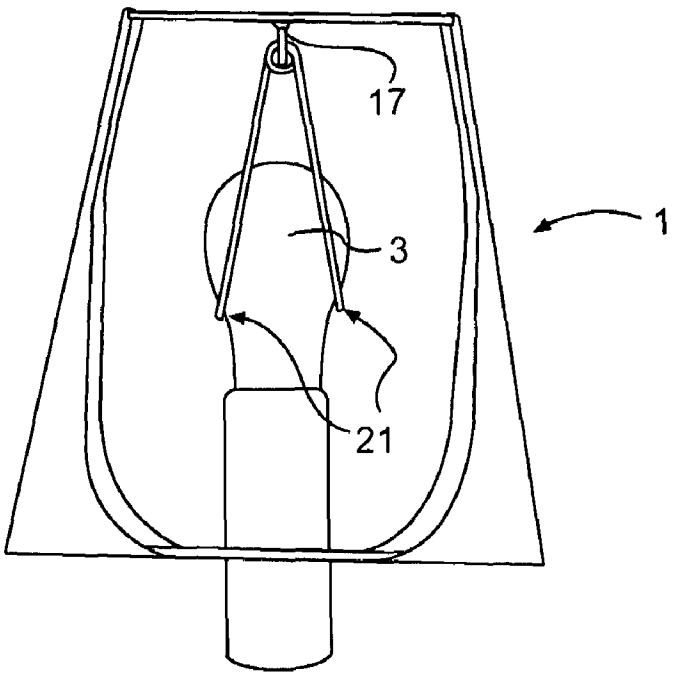
FIG. 4A is a partial broken side view of the lampshade of FIG. 1 in an upright position.
Figure 5:
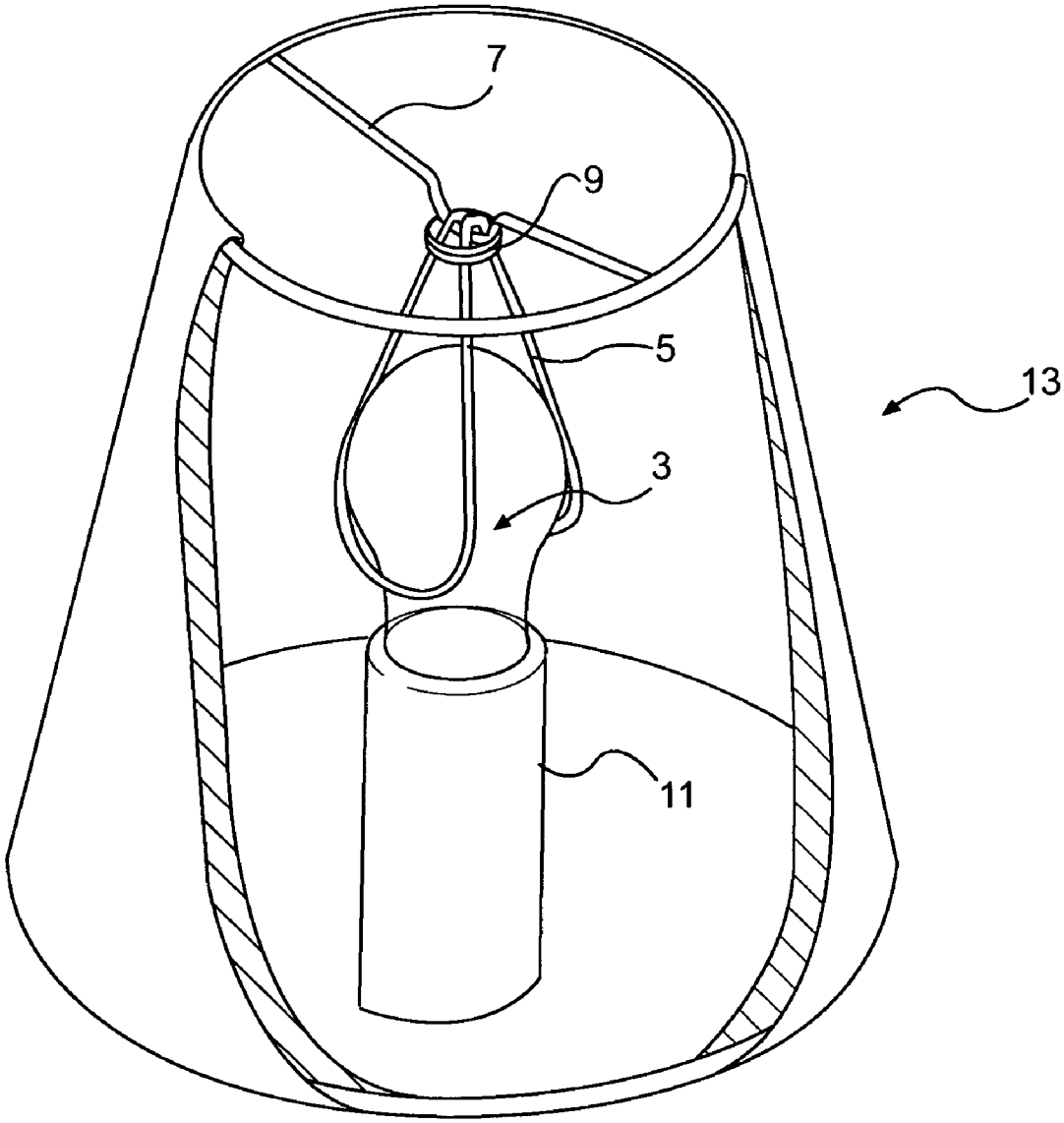
FIG. 5 is a perspective view of a conventional lampshade assembly.

Referring now to FIGS. 4A and 4B, FIG. 4A shows the lampshade 1 sifting atop the light bulb 3 in a typical upright position. In FIG. 4B, the lampshade 1 sits atop the light bulb 3 in a desired upright position. In the adjusted position of FIG. 4B, the lampshade 1 has been pivoted to the left (relative to the position of FIG. 4A) by pivoting the clip 21 relative to the cross-member 17 about the longitudinal axis of the cross-member 17. This adjustment may be made after the lampshade 1 has already been installed atop the light bulb 3. It should be appreciated that the lampshade 1 may also be pivoted to the right (relative to the position of FIG. 4A) by pivoting the clip 21 relative to the cross-member 17 about the longitudinal axis of the cross-member 17 in a similar manner.

According to various aspects of the disclosure, the lampshade 1 may be adjusted to a desired position wherein the clip 21 is pivoted relative to the cross-member 17 about the longitudinal axis of the cross-member 17 and about an axis substantially perpendicular to the cross-member 17. This adjustment may be made after the lampshade 1 has already been installed atop the light bulb 3.

It will be apparent to those skilled in the art that various modifications and variations can be made in the lampshade of the present disclosure without departing from the scope of the invention. Other embodiments of the invention will be apparent to those skilled in the art from consideration of the specification and practice of the invention disclosed herein. It is intended that the specification and examples be considered as exemplary only.

What is claimed is:

1. A lampshade comprising:

an upper rim;

a cross-member having two ends connected to the upper rim, the cross-member including a loop portion between the two ends;

a clip having a spring portion and two arms, the spring portion being connected to the loop portion of the cross-member, and the arms clamp to a lamp bulb;

the clip to be pivoted relative to the cross-member about a longitudinal axis of the cross-member and an axis substantially perpendicular to the cross-member to a desired pivoted position; and a shade material connected to said upper rim.

2. The lampshade of claim 1, wherein the loop portion and the spring portion engage one another at least one of a plurality of friction points.

3. The lampshade of claim 2, wherein the engagement between the loop portion and the spring portion maintains the lampshade in the desired pivoted position.

4. The lampshade of claim 1, wherein the spring portion encircles a segment of the loop portion.

5. The lampshade of claim 1, wherein the spring portion comprises a coil spring.

6. The lampshade of claim 1, wherein at least one of the upper rim, the cross-member, and the clip comprises a wire.

7. The lampshade of claim 1, wherein the upper rim is shaped as one of a circle, a square, a diamond.

8. The lampshade of claim 1, further comprising a lower rim, the shade material extending between the upper and lower rims.

9. A lamp comprising: a candlestick; a light source electrically connected with the candlestick; and the lampshade of claim 1 connected to the light source.

10. A lampshade comprising:

an upper rim;

a cross member having two ends connected to the upper rim, the cross-member including a loop portion between the two ends; a clip solidly mounted on the loop portion of the cross member, the clip having two arms that clamp to a light bulb;

the clip is to be pivoted relative to the cross-member about a longitudinal axis of the cross-member and an axis substantially perpendicular to the cross-member to a desired pivoted position; and a shade material connected to said upper rim.

11. The lampshade of claim 10, wherein the clip includes a spring portion, the loop portion and the spring portion engaging one another at least one of a plurality of friction points.

12. The lampshade of claim 11, wherein the engagement between the loop portion and the spring portion maintains the lampshade in the desired pivoted position.

13. The lampshade of claim 11, wherein the spring portion encircles a segment of the loop portion.

14. The lampshade of claim 11, wherein the spring portion comprises a coil spring.

15. The lampshade of claim 10, wherein at least one of the upper rim, the cross-member, and the clip comprises a wire.

16. The lampshade of claim 10, wherein the upper rim is shaped as one of a circle, a square, a diamond.

17. The lampshade of claim 10, further comprising a lower rim, the shade material extending between the upper and lower rims.

18. A lamp comprising: a candlestick; a light source electrically connected with the candlestick; and the lampshade of claim 10 connected to the light source.

* * * * *